US010040284B2

(12) United States Patent
Fujii

(10) Patent No.: US 10,040,284 B2
(45) Date of Patent: Aug. 7, 2018

(54) DISCHARGE ELEMENT SUBSTRATE, PRINTHEAD, AND PRINTING APPARATUS

(71) Applicant: CANON KABUSHIKI KAISHA, Tokyo (JP)

(72) Inventor: Yasuo Fujii, Hiratsuka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/190,557

(22) Filed: Jun. 23, 2016

(65) Prior Publication Data

US 2017/0001436 A1 Jan. 5, 2017

(30) Foreign Application Priority Data

Jul. 2, 2015 (JP) ..... 2015-133922

(51) Int. Cl.
*B41J 2/14* (2006.01)
*B41J 2/045* (2006.01)

(52) U.S. Cl.
CPC ..... *B41J 2/14072* (2013.01); *B41J 2/0455* (2013.01); *B41J 2/0458* (2013.01); (Continued)

(58) Field of Classification Search
CPC ..... B41J 2/14072; B41J 2/0458
See application file for complete search history.

(56) References Cited

U.S. PATENT DOCUMENTS

2005/0052499 A1* 3/2005 Oomura ..... B41J 2/04531 347/58
2008/0055368 A1* 3/2008 Oikawa ..... B41J 2/145 347/62

(Continued)

FOREIGN PATENT DOCUMENTS

JP 62261453 A * 11/1987
JP 2013-107408 A 6/2013
JP 2013107408 A * 6/2013

OTHER PUBLICATIONS

Machine generated English translation of JP2013107408 to Sakurai, "Liquid Discharge Head and Inkjet Recorder"; obtained via https://www.j-platpat.inpit.go.jp/web/all/top/BTmTopEnglishPage on Dec. 23, 2016; 10pp.*

*Primary Examiner* — Shelby Fidler
(74) *Attorney, Agent, or Firm* — Fitzpatrick, Cella, Harper & Scinto

(57) ABSTRACT

A discharge element substrate comprises a plurality of discharge elements each including a first electrical contact and a second electrical contact, a plurality of driving circuits arranged in a first direction and each connected to the plurality of discharge elements, and a plurality of driving wiring lines extending in a second direction that intersects with the first direction and configured to connect the plurality of driving circuits and the first electrical contact of the plurality of discharge elements. A length, in the second direction, of a first driving wiring line connecting the first driving circuit and the first electrical contact of the first discharge element is shorter than a length, in the second direction, of a second driving wiring line connecting the second driving circuit and the first electrical contact of the second discharge element.

21 Claims, 8 Drawing Sheets

(52) U.S. Cl.
CPC ..... *B41J 2/04541* (2013.01); *B41J 2/04548* (2013.01); *B41J 2202/13* (2013.01)

(56) References Cited

U.S. PATENT DOCUMENTS

2009/0015608 A1* 1/2009 Han ..... B41J 2/0451
347/9
2010/0201748 A1* 8/2010 Kishikawa ..... B41J 2/1404
347/50
2011/0292105 A1* 12/2011 Fujii ..... B41J 2/04541
347/9
2012/0056940 A1* 3/2012 Sakurai ..... B41J 2/1404
347/54
2013/0120502 A1* 5/2013 Sakurai ..... B41J 2/14072
347/58
2014/0198158 A1* 7/2014 Sakurai ..... B41J 2/14072
347/50
2015/0085020 A1* 3/2015 Sakurai ..... B41J 2/14072
347/58

* cited by examiner

DISCHARGE ELEMENT SUBSTRATE, PRINTHEAD, AND PRINTING APPARATUS

BACKGROUND OF THE INVENTION

Field of the Invention

The present invention relates to a discharge element substrate, a printhead, and a printing apparatus.

Description of the Related Art

In the case of a printing apparatus represented by a printer or the like, printing is performed on a printing medium by discharging ink from a printhead. Ink is discharged from an orifice by each discharge element, such as a heater, provided on a discharge element substrate. Other than the discharge elements such as heaters or the like, the discharge element substrate includes a plurality of elements and peripheral circuits such as an ink supply port, a discharge element driving circuit, and a power supply. Japanese Patent Laid-Open No. 2013-107408 discloses a printhead substrate in which a wiring line to drive a heater is provided on a beam portion that separates a plurality of ink supply ports from each other.

SUMMARY OF THE INVENTION

One aspect of the present invention is provides a discharge element substrate comprising a plurality of discharge elements each including a first electrical contact and a second electrical contact, a plurality of driving circuits arranged in a first direction and each connected to corresponding one of the plurality of discharge elements, a power supply electrode extending in the first direction, a plurality of driving wiring lines each extending in a second direction that intersects with the first direction and configured to connect one of the plurality of driving circuits and the first electrical contact of one of the plurality of discharge elements, and a plurality of power supply wiring lines each configured to connect the power supply electrode and the second electrical contacts of the plurality of discharge elements, wherein the plurality of discharge elements and the plurality of driving circuits form a plurality of groups each including at least one of a first discharge element, a first driving circuit connected to the first discharge element, a second discharge element, a second driving circuit connected to the second discharge element, and the plurality of power supply wiring lines, in each of the plurality of groups, a first distance from the first driving circuit to the first discharge element in the second direction is shorter than a second distance from the second driving circuit to the second discharge element in the second direction, and a length, in the second direction, of a first driving wiring line connecting the first driving circuit and the first electrical contact of the first discharge element is shorter than a length, in the second direction, of a second driving wiring line connecting the second driving circuit and the first electrical contact of the second discharge element, in each of the plurality of groups, the power supply wiring lines each include at least a first portion extending from the power supply electrode to the second electrical contact of the second discharge element in the second direction and a second portion extending from the second electrical contact of the first discharge element to the second electrical contact of the second discharge element in the second direction, and in each of the plurality of groups, the first portion and the second portion are aligned in the second direction.

Further features of the present invention will become apparent from the following description of exemplary embodiments (with reference to the attached drawings).

DESCRIPTION OF THE EMBODIMENTS (Example of Arrangement of Printing Apparatus)

An example of the arrangement of an inkjet printing apparatus will be described with reference to FIGS. 1A and 1B. The printing apparatus may be, for example, a single-function printer having only a printing function, or a multi-function printer having a plurality of functions such as a printing function, a facsimile function, and a scanner function. Furthermore, the printing apparatus can also include a manufacturing apparatus for manufacturing a color filter, an electronic device, an optical device, a microstructure, or the like by a predetermined printing method.

Figure 1A:
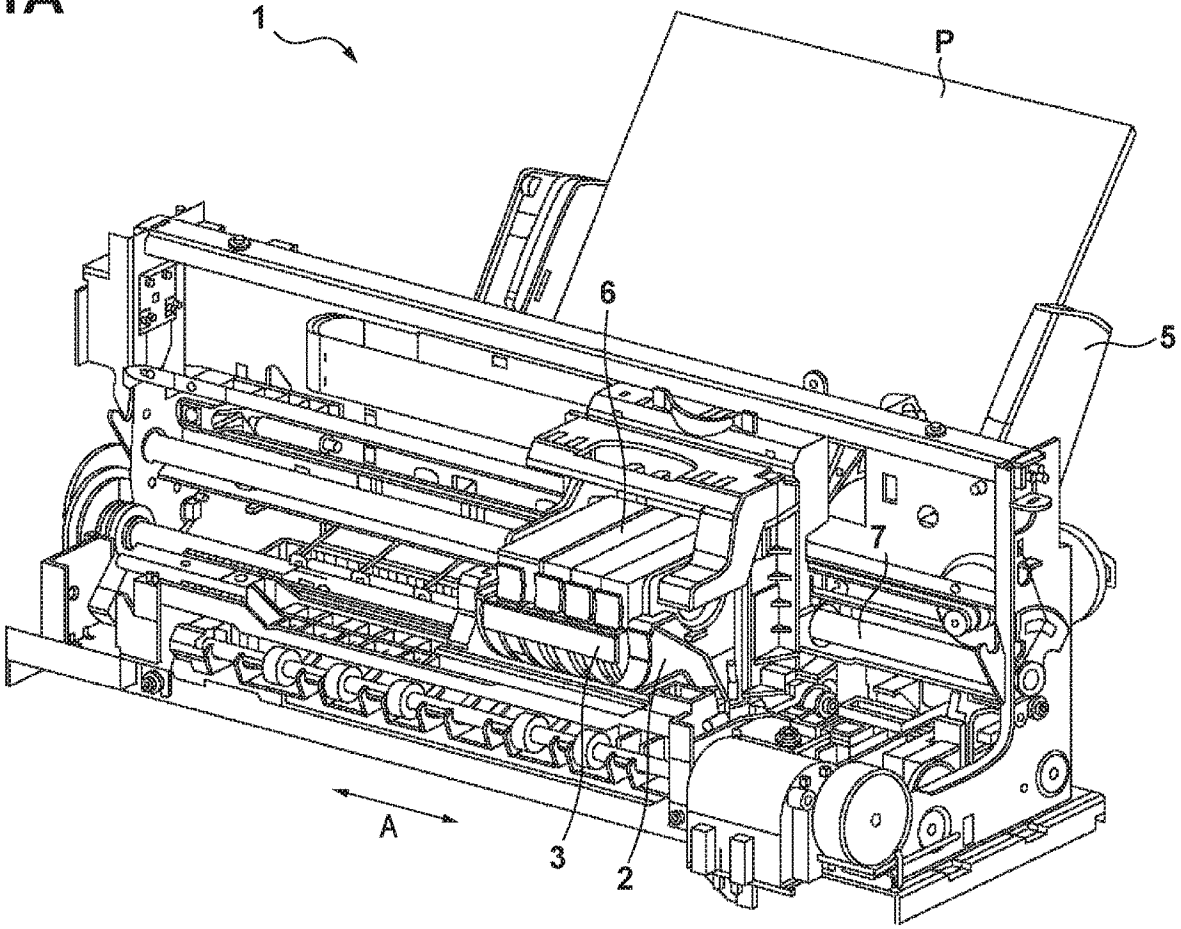
FIGS. 1A and 1B are a schematic view and a block diagram, respectively, showing an example of the arrangement of a printing apparatus.

FIG. 1A is a perspective view showing an example of the appearance of a printing apparatus. In the printing apparatus, a printhead 3 for discharging ink to execute printing is mounted on a carriage 2, and the carriage 2 reciprocates in directions indicated by an arrow A to execute printing. The printing apparatus feeds a printing medium P such as printing paper via a sheet supply mechanism 5, and conveys it to a printing position. At the printing position, the printing apparatus executes printing by discharging ink from the printhead 3 onto the printing medium P.

In addition to the printhead 3, for example, ink cartridges 6 are mounted on the carriage 2. Each ink cartridge 6 stores ink to be supplied to the printhead 3. The ink cartridge 6 is detachable from the carriage 2. The printing apparatus is capable of executing color printing. Therefore, in this example, four ink cartridges which contain magenta (M), cyan (C), yellow (Y), and black (K) inks are mounted on the carriage 2. These four ink cartridges are independently detachable.

The printhead 3 includes ink orifice (nozzles) for discharging ink, and also includes a discharge element substrate having electrothermal transducers (heaters) corresponding to the nozzles. A pulse voltage corresponding to a print signal is applied to each heater, and heat energy by the heater which has been applied with the pulse voltage generates bubbles in ink, thereby discharging ink from the nozzle corresponding to the heater.

Figure 1B:
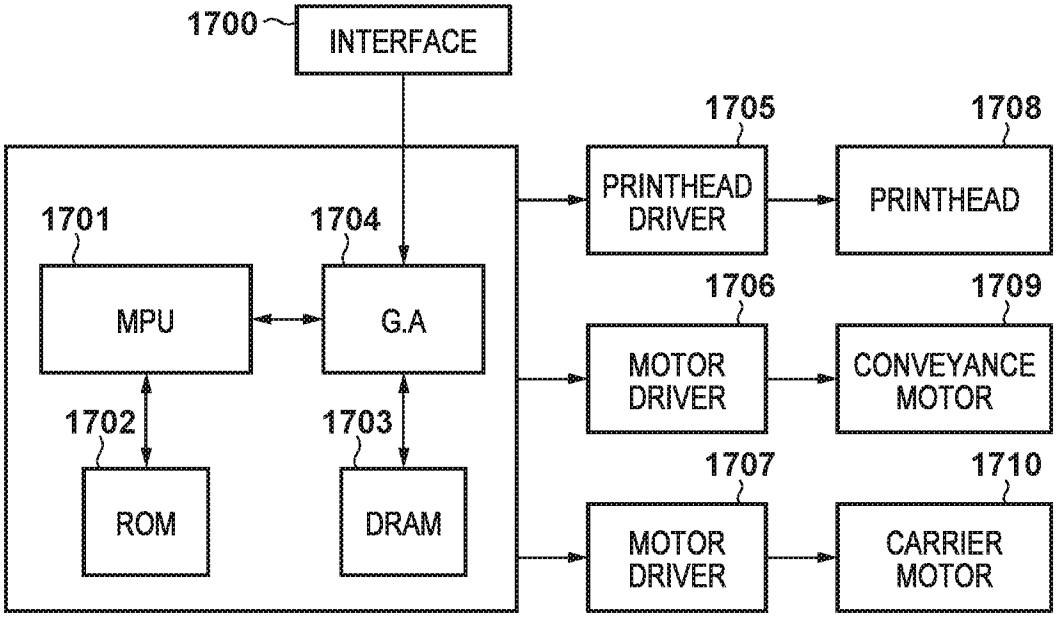

FIG. 1B exemplifies the system arrangement of the printing apparatus. The printing apparatus includes an interface 1700, an MPU 1701, a ROM 1702, a RAM 1703, and a gate array 1704. The interface 1700 receives a print signal. The ROM 1702 stores a control program to be executed by the MPU 1701. The RAM 1703 saves various data such as the aforementioned print signal, and print data supplied to a printhead 1708. The gate array 1704 controls print data to the printhead 1708, and also controls data transfer between the interface 1700, the MPU 1701, and the RAM 1703.

The printing apparatus further includes a printhead driver 1705, motor drivers 1706 and 1707, a conveyance motor 1709, and a carrier motor 1710. The printhead driver 1705 drives the printhead 1708. The motor drivers 1706 and 1707 drive the conveyance motor 1709 and the carrier motor 1710, respectively. The conveyance motor 1709 conveys a printing medium. The carrier motor 1710 conveys the printhead 1708.

When a print signal is input to the interface 1700, it can be converted into print data of a predetermined format by the gate array 1704 and the MPU 1701. Each mechanism performs a desired operation in accordance with the print data to execute printing.

(First Embodiment)

Figure 2:
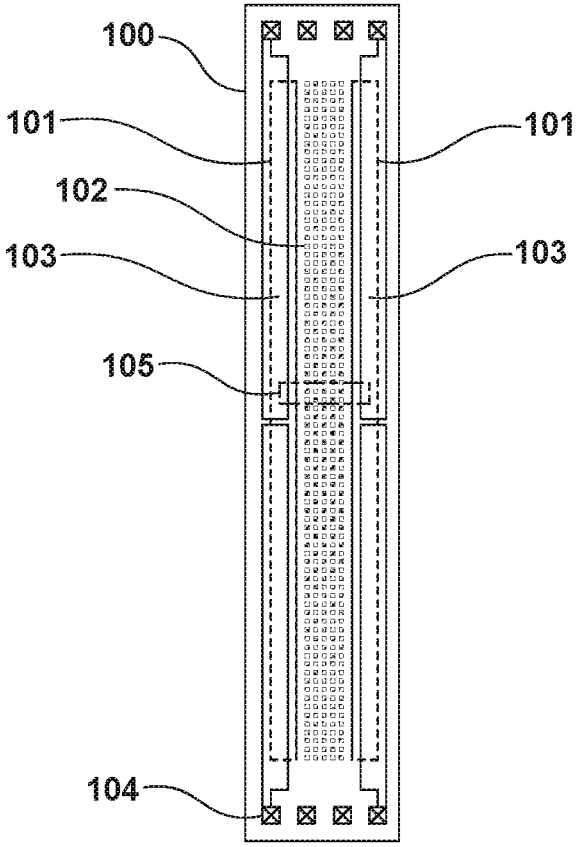
FIG. 2 is a schematic view of a discharge element substrate according to the first embodiment.
Figure 3:
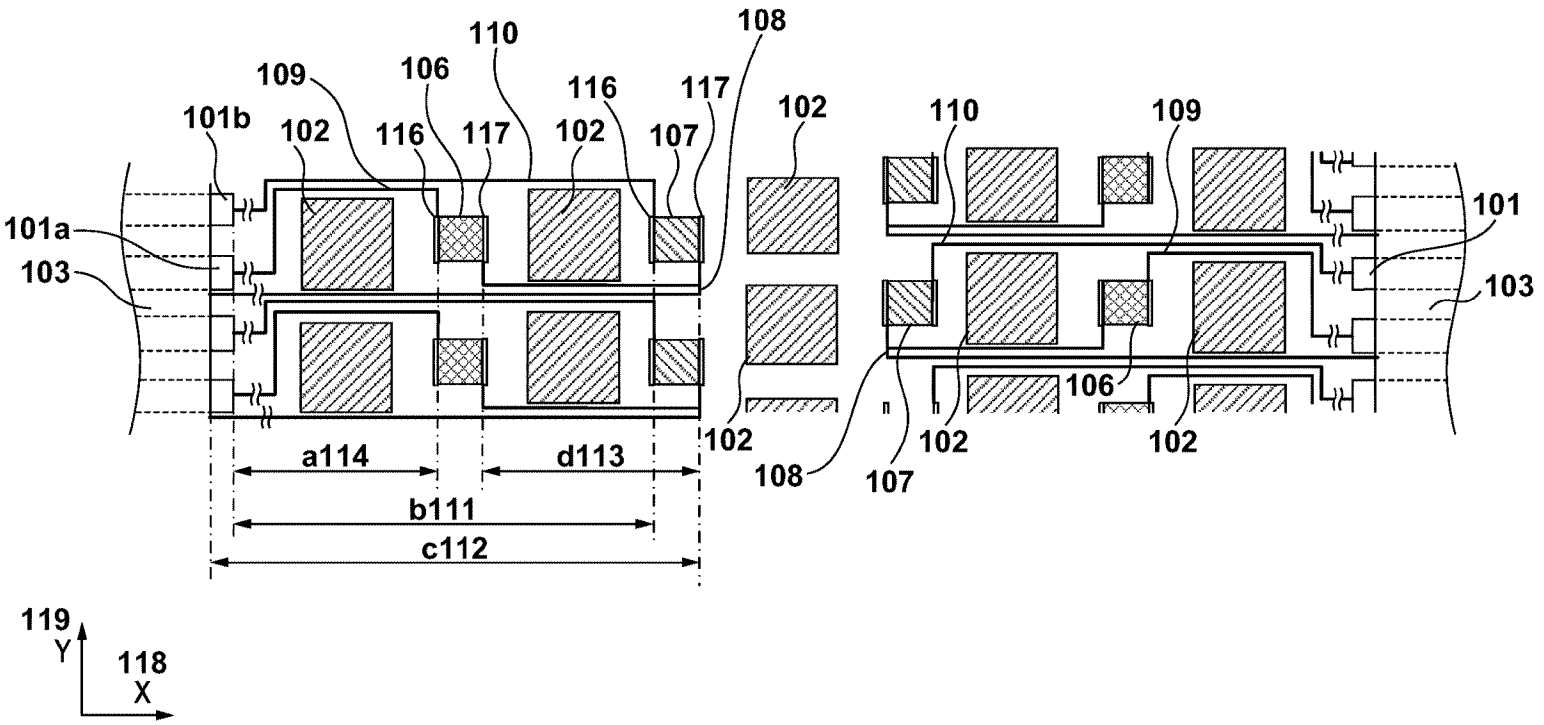
FIG. 3 is an enlarged view of the discharge element substrate according to the first embodiment.

A discharge element substrate 100 according to the first embodiment will be described with reference to FIGS. 2 and 3. The discharge element substrate 100 includes discharge elements (not shown) as energy generating elements that generate energies to discharge a liquid such as ink or the like. In the first embodiment, a heater that discharges ink by heat energy is used for each discharge element. A plurality of driving circuits 101 each of which drives a plurality of heaters are arranged in a first direction that is along a first side of the discharge element substrate 100. The first direction is, for example, the vertical direction in FIG. 2.

A plurality of heaters (discharge elements) are provided in correspondence with each driving circuit 101. The plurality of heaters corresponding to one driving circuit 101 are arranged along axis in a second direction which intersects with the first direction. The second direction is, for example, the horizontal direction in FIG. 2. Since the plurality of driving circuits 101 are arranged in the first direction and the plurality of heaters corresponding to each driving circuit 101 are arranged in the second direction, the plurality of heaters can be arranged so as to form a plurality of lines in the first direction.

Each heater includes a first electrical contact 116 and a second electrical contact 117. An electrical contact is a portion that is connected to an electrically conductive member forming a wiring line. Power supply electrodes 103 each supplying a power supply voltage to the heater are shown in FIG. 2. Each power supply electrode 103 is provided to extend along the first side of the discharge element substrate 100 in the first embodiment. Although not illustrated in FIG. 2, a wiring line that forms a power supply path from the output terminal of each driving circuit 101 to the heaters is so provided as to correspond with the heaters. Although not illustrated in FIG. 2, power supply electrodes that supply a ground voltage to the heaters are also arranged.

A transistor which forms each driving circuit 101 is formed on the discharge element substrate 100. Each power supply electrode 103 can be stacked and arranged on the discharge element substrate 100. As shown in FIG. 2, the driving circuits 101 and the power supply electrodes 103 are arranged at overlapping positions, respectively, in planar view of the discharge element substrate 100. Each power supply electrode 103 can be divided into two portions around the middle of the first side of the discharge element substrate 100. Electrode pads 104 to electrically connect with the outside are arranged on each edge of the discharge element substrate 100. Power supply and input/output of a control signal from the outside to the heaters, driving circuits 101, and the power supply electrodes 103 are performed via the electrode pads 104. Since a current for the heaters is flowing in each power supply electrode 103, it is advantageous to have a structure with a large width so as to reduce the resistance. In addition, by dividing each power supply electrode 103 and supplying a power supply voltage from the electrode pad 104 which is provided on each of the divided power supply electrodes, the length from the electrode pad 104 to the heaters can be shortened. By making each power supply electrode 103 have such a structure, it can sufficiently reduce the voltage drop in the power supply electrode 103.

Each supply port 102 that supplies ink to a heater is arranged in correspondence with the heater. Each supply port 102 is formed to extend through the discharge element substrate 100. Between the supply port 102 and another supply port 102 arranged next to the supply port 102 in the first direction, a wiring line to transmit a control signal or a wiring line to supply a power supply voltage or a ground voltage may be arranged.

A portion 105 surrounded by a broken line on the discharge element substrate 100 will be explained with reference to FIG. 3. Each first heater 106 and each second heater 107 are aligned along axis in the second direction in the first embodiment. In FIG. 3, the second direction is indicated as an X-axis 118. A plurality of heaters including the first heaters 106 are arranged in the first direction. A plurality of heaters including the second heaters 107 are arranged in the first direction. In FIG. 3, the first direction is indicated as a Y-axis 119.

Each of the first heaters 106 and the second heaters 107 is arranged between the supply ports 102. Compared to the first heater 106, the second heater 107 is arranged at a position away from the corresponding driving circuit 101. That is, the distance from the driving circuit 101 to the corresponding first heater 106 is shorter than the distance from the driving circuit 101 to the corresponding second heater 107 along axis in the second direction. In the first embodiment, the second heaters 107, out of the plurality of the heaters connected to the power supply electrodes 103, are arranged farthest from the driving circuits 101.

The second electrical contact 117 of each first heater 106 and the second electrical contact 117 of each second heater 107 are connected to the corresponding power supply electrode 103 via a power supply wiring line 108. The first electrical contact 116 of each first heater 106 and a corresponding driving circuit 101*a* that drives the first heater 106 are connected by a first driving wiring line 109. The first electrical contact 116 of each second heater 107 and a corresponding driving circuit 101*b* that drives the second heater 107 are connected by a second driving wiring line 110.

One end of each power supply wiring line 108 is connected to the corresponding power supply electrode 103. The other end of the power supply wiring line 108 is connected to the second electrical contact 117 of the corresponding second heater 107, out of the plurality of heaters connected to the power supply electrode 103, arranged farthest from the driving circuits 101*a* and 101*b*. The power supply wiring line 108 further includes a portion branching from the second electrical contact 117 of the second heater 107. One end of the portion branching from the power supply wiring line 108 is connected to the second electrical contact 117 of the first heater 106 at a position closer to the driving circuits 101 than the second heater 107.

In the first embodiment, the driving circuits 101*a* and 101*b*, the first heater 106, the second heater 107, the first driving wiring line 109, and the second driving wiring line 110 are included in one group. This group further includes the power supply wiring line 108 commonly connected to the first heater 106 and the second heater 107. A plurality of these groups are arranged in the first direction on the discharge element substrate 100.

Each power supply wiring line 108 extends from the power supply electrode 103 to the second electrical contact 117 of the corresponding second heater 107, is connected to the second electrical contact 117 of the second heater 107, and branches from the second electrical contact 117 to return toward the power supply electrode 103. Next, the returned power supply wiring line 108 extends toward the first heater 106 at a position closer to the driving circuits than the second heater 107 and is connected to the second electrical contact 117 of the first heater 106. In other words, the power supply wiring line 108 includes at least a first portion and a second portion that are arranged in parallel. In this case, assume that the first portion is a portion extending in the second direction from the power supply electrode 103 to the second electrical contact 117 of the second heater 107. Assume that the second portion is a portion extending in the second direction from the second electrical contact 117 of the first heater 106 to the second electrical contact 117 of the second heater 107.

The wiring line to supply power to each first heater 106 is constituted by the power supply wiring line 108 and the first driving wiring line 109. In other words, the power supply wiring line 108, the first heater 106, and the first driving wiring line 109 form an electrical path in which a current flows from the driving circuit 101*a* to the power supply voltage node (the power supply electrode 103). When the power supply wiring line 108 and the first driving wiring line 109 are decomposed into the lengths of the directions of the X-axis 118 indicating the second direction and the Y-axis 119 indicating the first direction in FIG. 3, the wiring length in the X-axis direction occupies most of the wiring length. Therefore, when considering the voltage drop due to the wiring length, the wiring length in the X-axis direction need only be considered. The wiring length of the power supply wiring line 108 includes a wiring length c112 which is the length of the wiring line from the power supply electrode 103 to the second electrical contact 117 of the second heater 107. The power supply wiring line 108 further includes a wiring length d113 which is the length of the wiring line from the second electrical contact 117 of the second heater 107 to the second electrical contact 117 of the first heater 106. Hence, the wiring length of the power supply wiring line 108 connected to the first heater 106 is the total of the wiring length c112 and the wiring length d113. The wiring length of the first driving wiring line 109 is indicated by a wiring length a114. Therefore, the wiring length of the wiring line to supply power to the first heater 106 becomes the total value of the wiring length c112, the wiring length d113, and the wiring length a114.

The wiring line to supply power to the second heater 107 is constituted by the second driving wiring line 110 and a portion, out of the power supply wiring line 108, which extends from the power supply electrode 103 to the second electrical contact 117 of the second heater 107. In other words, the power supply wiring line 108, the second heater 107, and the second driving wiring line 110 form an electrical path in which a current flows from the driving circuit 101*b* to the power supply voltage node (power supply electrode 103). When the power supply wiring line 108 and the second driving wiring line 110 are decomposed into the X-axis 118 and the Y-axis 119, the wiring line in the X-axis direction occupies most of the wiring length. Therefore, when considering the voltage drop due to the wiring length, the wiring length in the X-axis direction need only be considered. Assume that the wiring length c112 indicates the wiring length of the portion, out of the power supply wiring line 108, from the power supply electrode 103 to the second electrical contact 117 of the second heater 107. A wiring length bill indicates the wiring length of the second driving wiring line 110. Therefore, the wiring length of the wiring line to supply power to the second heater 107 is the total of the wiring length c112 and the wiring length bill.

The wiring length bill is almost equal to the total of the wiring length d113 and the wiring length a114. Thus, the sum of wiring length c, wiring length d and wiring length a is equal to the sum of wiring length c and wiring length b. Therefore, in the first embodiment, the wiring length of the wiring line to supply power to the first heater 106 and the wiring length of the wiring line to supply power to the second heater 107 are almost equal.

In this manner, the power supply wiring line 108 is connected to the second electrical contact 117 of the second heater 107 farthest from the power supply electrode 103 in the X-direction. Then, via this connection serving as a branch point, the power supply wiring line 108 is connected from the second heater 107 to the first heater 106 at a close position to the driving circuits 101*a* and 101*b*. As a result, the wiring lengths of the paths connected to the respective first heater 106 and the second heater 107 can be made uniform. Hence, the wiring resistances of the current paths driving the first heater 106 and the second heater 107, respectively, can be the equal and the electrical energies supplied to the first heater 106 and the second heater 107 can be equalized to improve the printing quality.

Although the first embodiment has described a case in which two heaters are included in one group, the same wiring line arrangement can be made even in a case in which a predetermined number of three or more heaters are included in one group. In such a case, the power supply wiring line 108 is connected to the second electrical contact 117 of a heater at a position second farthest from the driving circuits via the second electrical contact 117 of the heater at a position farthest from the driving circuits serving as the branch point. Furthermore, the power supply wiring line 108 is sequentially connected to the second electrical contact 117 of each heater on a side closer to the driving circuits. That is, the second electrode of each heater is connected sequentially, by the power supply wiring line 108, first from the second electrical contact 117 of the heater at a position farthest from the driving circuits 101 and to the second electrical contact 117 of the second farthest heater, in this order from the farthest from the driving circuits to the closest. In addition, the driving wiring line from each driving circuit is arranged in accordance with the distance between the heaters and each driving circuit, so that the driving wiring line to the heater at a position farthest from the output terminal of the corresponding driving circuit becomes the longest and the driving wiring line to the heater at a position closest to the driving circuit becomes the shortest. In this manner, the wiring lengths of the heaters can be made to have the same value by a simple wiring layout. A common driving circuit for a plurality of heaters may be provided between the power supply electrode and the power supply wiring line 108 to improve the driving force.

(Second Embodiment)

Figure 4:
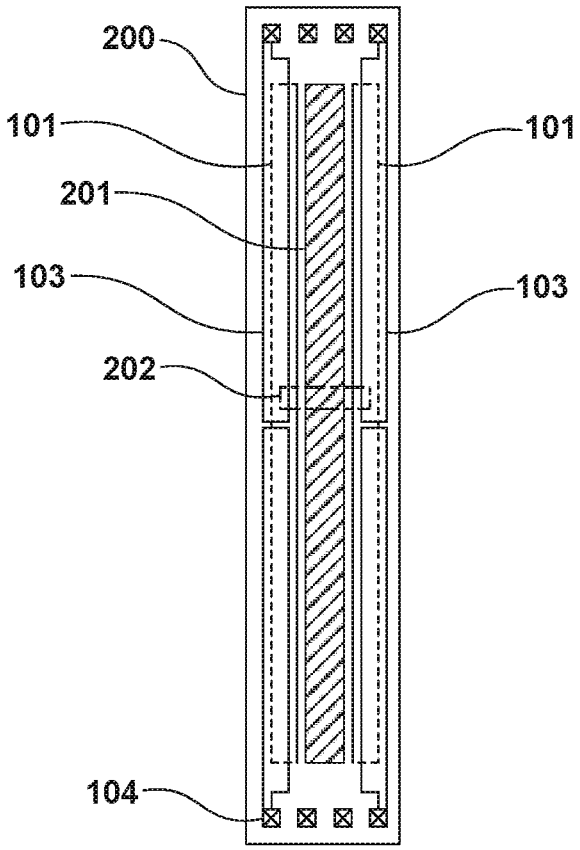
FIG. 4 is a schematic view of a discharge element substrate according to the second embodiment.

A discharge element substrate 200 according to the second embodiment will be described with reference to FIG. 4. In the second embodiment, driving circuits 101 and power supply electrodes 103 are also arranged at overlapping positions on the discharge element substrate 200. The second embodiment differs from the first embodiment in the arrangement of the supply port. Differences from the first embodiment will be described. A description of arrangements that are same as those in the first embodiment will be omitted.

A plurality of driving circuits 101 are arranged linearly in a first direction along a first side of the discharge element substrate 200. A supply port 201 that supplies ink to heaters (not shown) is formed to extend through the discharge element substrate 200 in the first direction. A plurality of heaters which are adjacent to the supply port 201 are arranged in the first direction and a second direction intersecting with the first direction. In FIG. 4, the driving circuits 101 and the power supply electrodes 103 are arranged along each of the first side and a second side facing the first side of the discharge element substrate 200, and the supply port 201 is arranged between them.

Figure 5:
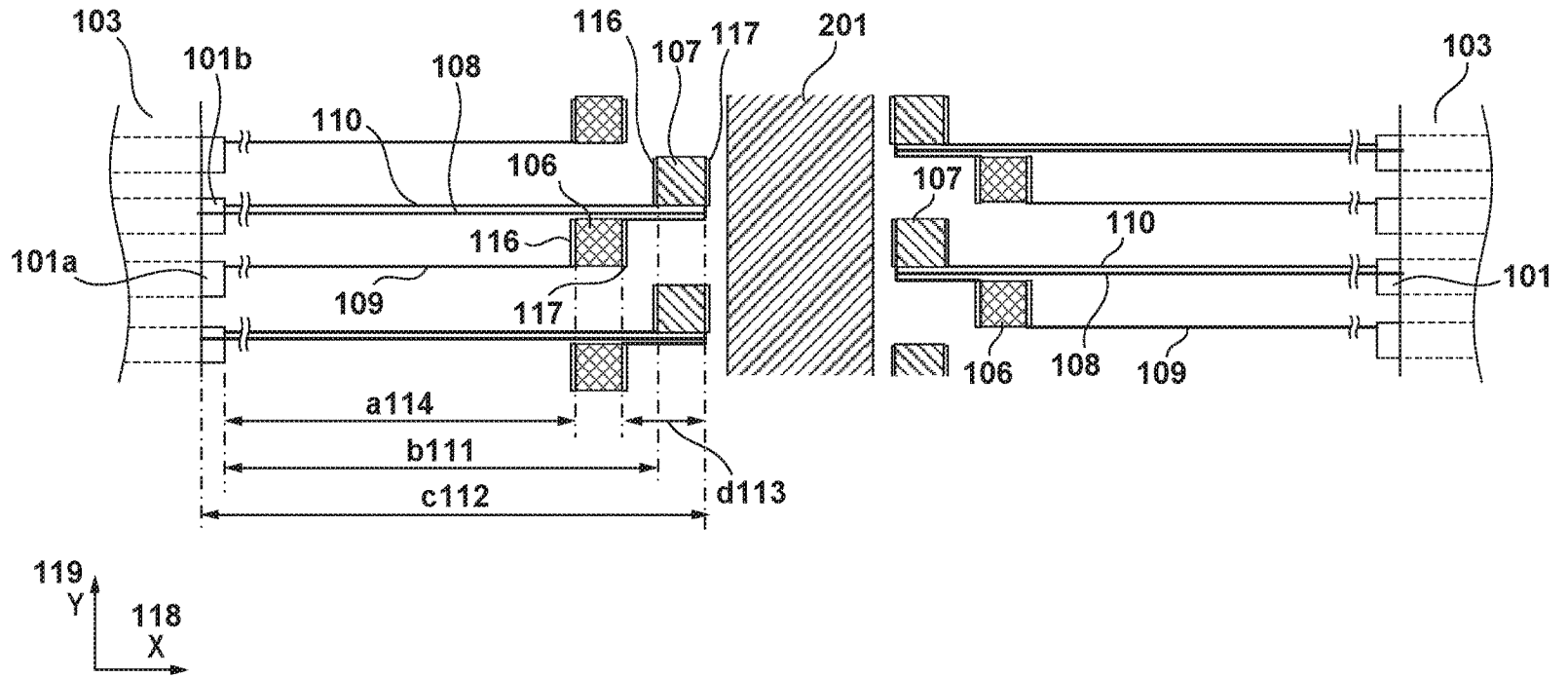
FIG. 5 is an enlarged view of the discharge element substrate according to the second embodiment.

A portion 202 shown in FIG. 4 will be described with reference to FIG. 5. Each first heater 106 and each second heater 107, which are arranged in the second direction, are commonly connected to the same power supply wiring line 108. The first heater 106, the second heater 107, and the power supply wiring line 108 which commonly connects the first heater 106 and the second heater 107 are all included in one group. A plurality of such groups are arranged in the first direction. The first heater 106 and the second heater 107 are arranged at positions of different distances from driving circuits 101*a* and 101*b*, respectively. The distance from the center of the first heater 106 to the portion closest to the first heater 106 of the supply port 201 is longer than the distance from the center of the second heater 107 to the portion closest to the second heater 107 of the supply port 201.

Power supply to each first heater 106 is performed by a first driving wiring line 109 and the power supply wiring line 108. Each power supply wiring line 108 extends from the power supply electrode 103 to the corresponding second heater 107 and is connected to a second electrical contact 117 of the second heater 107. The power supply wiring line 108 returns from a portion branching from the second electrical contact 117 of the second heater 107 to the power supply electrode 103 and is connected to the second electrical contact 117 of the first heater 106. In other words, the power supply wiring line 108 includes at least two portions. It has a first portion extending from the power supply electrode 103 to the second electrical contact 117 of the second heater 107 in the second direction and a second portion extending from the second electrical contact 117 of the first heater 106 to the second electrical contact 117 of the second heater 107 in the second direction. The first portion and the second portion are arranged in parallel. A first electrical contact 116 of the first heater 106 and the driving circuit 101*a* that drives the first heater 106 are connected by the first driving wiring line 109. The first electrical contact 116 of the second heater 107 and the driving circuit 101*b* that drives the second heater 107 are connected by a second driving wiring line 110.

When the power supply wiring line 108 and the first driving wiring line 109 are decomposed into an X-axis 118 indicating the second direction and a Y-axis 119 indicating the first direction, the wiring length in the X-axis direction occupies most of the length of the wiring line that supplies power to the first heater 106. Therefore, when considering the wiring length, the length in the X-axis direction need only be considered. As shown in FIG. 5, the total of a wiring length a114, a wiring length d113, and a wiring length c112 becomes the wiring length to supply power to the first heater 106. In the same manner, the total of the wiring length c112 and a wiring length bill becomes the length of the wiring line to supply power to the second heater 107. The wiring length bill is almost equal to the total of the wiring length a114 and the wiring length d113. As a result, the wiring lengths of the paths from the power supply electrode 103 and the driving circuits 101 to the respective first heater 106 and second heater 107 can be made uniform. Hence, the wiring resistances in the current paths supplying power to the first heater 106 and the second heater 107, respectively, can be the equal, and the electrical energies to the first heater 106 and the second heater 107 can be equalized to improve the printing quality. Although a case in which two heaters are connected to the power supply wiring line 108 is shown in the second embodiment, the embodiment can be applied to a case in which three or more heaters are connected. In addition, a common driving circuit for the plurality of heaters may be provided between the power supply electrode and the power supply wiring line 108.

(Third Embodiment)

Figure 6:
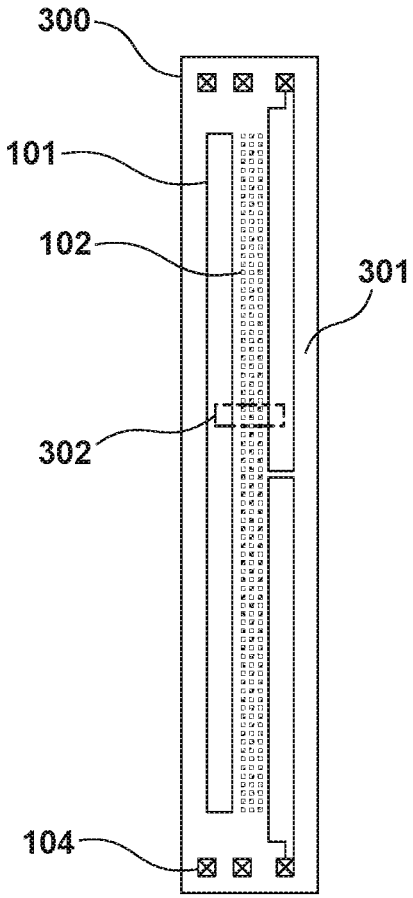
FIG. 6 is a schematic view of a discharge element substrate according to the third embodiment.

FIG. 6 is a schematic view for explaining a discharge element substrate 300 that forms a discharge head to discharge a liquid according to the third embodiment of the present invention. The arrangement of driving circuits 101 and power supply electrodes 301 differs between the first and second embodiments. Differences from the other embodiments will be described. A description of arrangements that are the same as those in the other embodiments will be omitted.

A plurality of supply ports 102 each extending through the substrate are formed in the discharge element substrate 300. A plurality of heaters (not shown) to discharge ink that is supplied from the supply ports 102 and the power supply electrodes 301 each forming the electrical power supply path to the heaters or the plurality of driving circuits 101 each driving the plurality of heaters are provided on the discharge element substrate 300. In the third embodiment, the plurality of supply ports 102 are arranged between the plurality of driving circuits 101 arranged in a first direction along a first side of the discharge element substrate 300 and the power supply electrodes 301 arranged along a second side facing the first side of the discharge element substrate 300. The plurality of heaters are arranged in correspondence with these plurality of supply ports.

Figure 7:
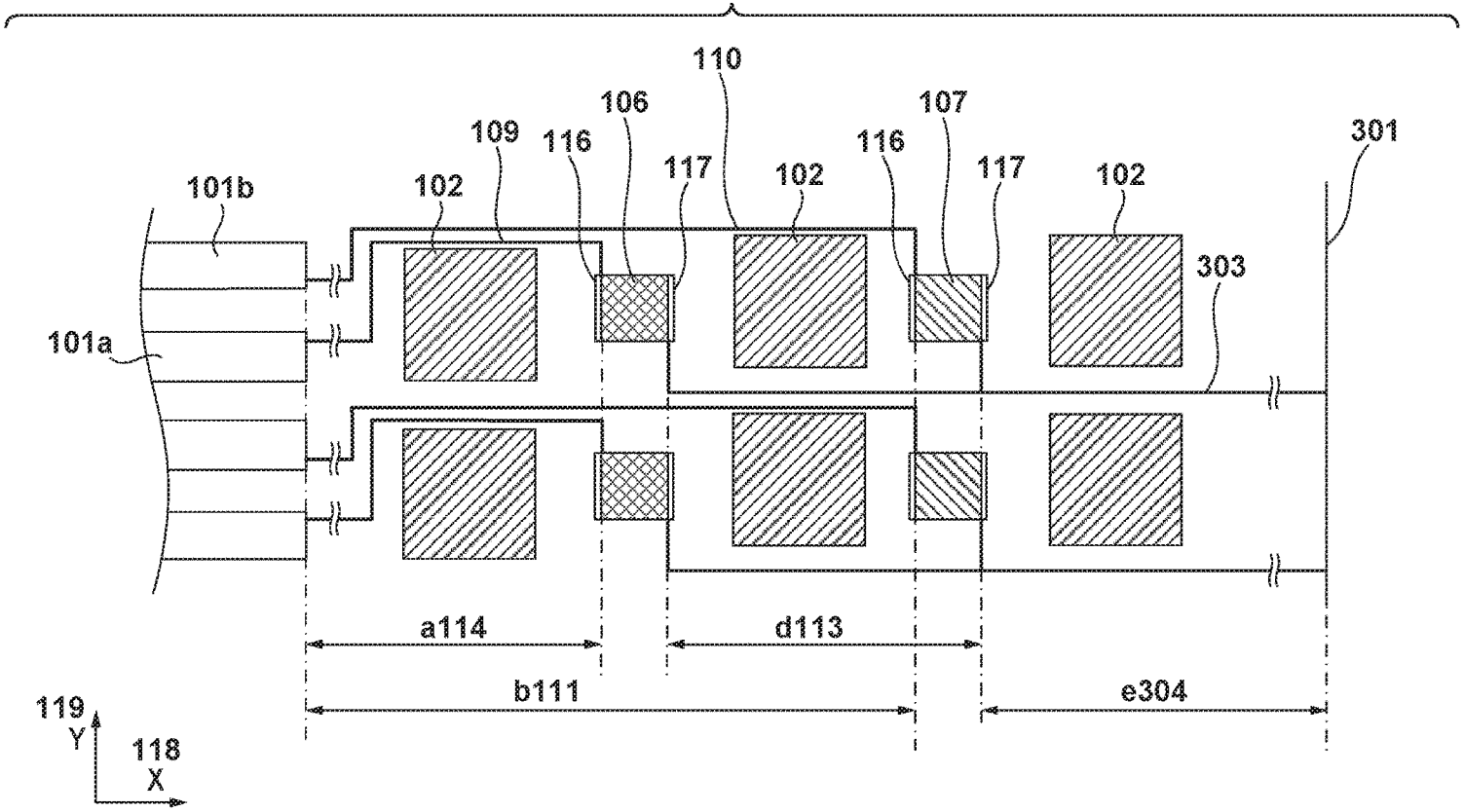
FIG. 7 is an enlarged view of the discharge element substrate according to the third embodiment.

A portion 302 shown in FIG. 6 will be described with reference to FIG. 7. Each first heater 106 and each second heater 107, aligned in the second direction intersecting with the first direction, are commonly connected to a corresponding power supply wiring line 303. A first electrical contact 116 of each first heater 106 and a corresponding driving circuit 101*a* that drives the first heater 106 are connected by a first driving wiring line 109. The first electrical contact 116 of the second heater 107 and a corresponding driving circuit 101*b* that drives the second heater 107 are connected by a second driving wiring line 110.

The first heater 106 and the second heater 107 are commonly connected to a corresponding power supply wiring line 303 from the power supply electrode 301. The power supply wiring line 303 extends from the power supply electrode 301 and is connected to a second electrical contact 117 of the second heater 107 that is farthest from the driving circuits 101*a* and 101*b*. The power supply wiring line 303 is further connected to the second electrical contact 117 of the first heater 106 that is closer to the driving circuits 101*a* and 101*b* than the second heater 107. In the third embodiment, the power supply wiring line 303 includes a portion which is connected to the second electrical contact 117 of the second heater 107, a portion which branches from the second electrical contact 117 of the second heater 107, and a portion which extends from the branch and is connected to the second electrical contact 117 of the first heater 106. The first heater 106 and the second heater 107 are arranged between the supply ports 102. The first driving wiring line 109 that supplies power to the first heater 106 extends from the output terminal of the driving circuit 101*a* and passes near the supply port 102 to be connected to the first electrical contact 116 of the first heater 106. The second driving wiring line 110 that supplies power to the second heater 107 extends from the output terminal of the driving circuit 101*b* and passes near the supply ports 102 to be connected to the first electrical contact 116 of the second heater 107. The first heater 106 and the second heater 107 commonly connected by the power supply wiring line 303, the driving circuit 101*a*, the driving circuit 101*b*, the supply ports 102, and the power supply electrode 301 are included in one group. A plurality of groups are arranged in the first direction on the discharge element substrate 300.

The power supply wiring line 303 from the power supply electrode 301 is connected to the second electrical contact 117 of the second heater 107 farthest from the driving circuits 101. Furthermore, the power supply wiring line 303 branches from the second electrical contact 117 and is connected to the second electrical contact 117 of the first heater 106 second farthest from the driving circuits. In this manner, the power supply wiring line 303 sequentially connects the second electrical contacts 117 of the heaters.

When the power supply wiring line 303 to the first heater 106 and the first driving wiring line 109 are decomposed into an X-axis 118 indicating the second direction and a Y-axis 119 indicating the first direction, the wiring line in the X-axis direction occupies most of the wiring length. Therefore, when considering the voltage drop due to the wiring length, the wiring length in the X-axis direction need only be considered. The length of the wiring line that supplies power to the first heater 106 is the total of the wiring length of the power supply wiring line 303 from the power supply electrode 301 to the first heater 106 and the wiring length of the first driving wiring line 109. This is indicated by the total of a wiring length e304, a wiring length d113, and a wiring length a114 of the first driving wiring line 109. The wiring length from the power supply electrode 301 and the driving circuit 101*b* to the second heater 107 is indicated by the total of the wiring length of the power supply wiring line 303 extending from the power supply electrode 301 to the second heater 107 and the wiring length of the second driving wiring line 110. The wiring length e304 indicates the wiring length from the power supply electrode 301 to the second heater 107, and a wiring length bill indicates the wiring length of the second driving wiring line 110. Hence, the wiring length between the second heater 107, the power supply electrode 301, and the driving circuits 101 becomes a value obtained by adding the wiring length e304 and the wiring length bill. Wiring length b is the sum of wiring length a and wiring length d. Thus, the sum of wiring length e, wiring length d and wiring length a is equal to the sum of wiring length e and wiring length b.

In the third embodiment, each power supply wiring line 303 is connected to the first heater 106 at a close position to the driving circuits after being connected to the second heater 107 farthest from the driving circuits. As a result, the wiring lengths of the current paths of the first heater 106 and the second heater 107 can be made uniform. Hence, wiring resistances to the first heater 106 and the second heater 107 become equal, and the electrical energies supplied to the first heater 106 and the second heater 107 can be equalized to improve the printing quality. Although the third embodiment shows a case in which the power supply wiring line 303 is commonly arranged for two heaters, the same arrangement can be applied to a case having three or more heaters. A common driving circuit for the plurality of heaters may be provided between the power supply electrode 301 and the power supply wiring line 303.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133922, filed Jul. 2, 2015, which is hereby incorporated by reference herein in its entirety.

What is claimed is:

1. A discharge element substrate comprising:

groups arranged along a first direction, each of the groups comprising a first discharge element, a first driving circuit electrically connected to the first discharge element, a second discharge element, a second driving circuit electrically connected to the second discharge element, and a power supply wiring line including a common portion, a first portion and a second portion;

a power supply electrode extending in the first direction; and first supply ports arranged along the first direction, each of the first supply ports corresponding to one of the groups, wherein, in each of the groups, the first driving circuit and the second driving circuit are arranged along the first direction, wherein, in each of the groups, the second discharge element and the power supply electrode are connected via the common portion and the first portion of the power supply wiring line, and the first discharge element and the power supply electrode are connected via the common portion and the second portion of the power supply wiring line, wherein, in each of the groups, a length of the first portion is smaller than a length of the second portion, wherein, in each of the groups, in a second direction which intersects the first direction, a first distance from the first driving circuit to the first discharge element is smaller than a second distance from the second driving circuit to the second discharge element, wherein, in each of the groups, in the second direction, a length of a first driving wiring line connecting the first driving circuit and the first discharge element is smaller than a length of a second driving wiring line connecting the second driving circuit and the second discharge element, and wherein the common portion and the second portion are arranged between two first supply ports which are adjacent to each other in the first direction.

2. The substrate according to claim 1, wherein the first discharge element and the second discharge element are aligned along the second direction.

3. The substrate according to claim 1, wherein the first discharge element is arranged between the first driving circuit and the second discharge element.

4. The substrate according to claim 1, further comprising second supply ports arranged along the first direction, wherein a column of the first supply ports and a column of the second supply ports are arranged in the second direction.

5. The substrate according to claim 4, wherein the second discharge element is arranged between the second driving circuit and one of the second supply ports.

6. The substrate according to claim 1, wherein the first discharge element is arranged between the first driving circuit and one of the first supply ports.

7. The substrate according to claim 1, wherein a contact portion of the second discharge element with the second driving circuit is arranged between a contact portion of the second discharge element with the power supply wiring line and the second driving circuit, and wherein the second portion of the power supply wiring line is branched from the first portion and is connected to the first discharge element.

8. A printhead comprising:

the discharge element substrate cited in claim 1;

an orifice configured to discharge a liquid under control of the discharge element substrate; and a liquid container configured to contain ink.

9. A printing apparatus comprising:

the printhead cited in claim 8; and a supply unit configured to supply a driving signal for causing the printhead to discharge a liquid.

10. The discharge element substrate according to claim 1, wherein the first discharge element is arranged between the power supply electrode and the second discharge element in the second direction.

11. The discharge element substrate according to claim 1, wherein the first discharge element includes:

a first electrical contact connected to the first driving circuit; and a second electrical contact connected to the power supply electrode, wherein the first electrical contact and the second electrical contact are arranged along in the second direction.

12. The discharge element substrate according to claim 1, wherein the first discharge elements included in the groups are arranged along the first direction.

13. The substrate according to claim 1, wherein each of the first supply ports is arranged between the first discharge element and the second discharge element of corresponding one of the groups.

14. A discharge element substrate comprising:

groups arranged along a first direction, each of the groups comprising a first discharge element, a first driving circuit electrically connected to the first discharge element, a second discharge element, and a second driving circuit electrically connected to the second discharge element;

a power supply electrode extending in the first direction; and first supply ports arranged along in the first direction, each of the first supply ports corresponding to one of the groups, wherein, in each of the groups, the first driving circuit and the second driving circuit are arranged along the first direction, wherein, in each of the groups, in a second direction which intersects the first direction, a first distance from the first driving circuit to the first discharge element in the second direction is smaller than a second distance from the second driving circuit to the second discharge element in the second direction, wherein, in each of the groups, in the second direction, a length of a first driving wiring line connecting the first driving circuit and the first discharge element is smaller than a length of a second driving wiring line connecting the second driving circuit and the second discharge element, wherein, in each of the groups, a first end of a power supply wiring line is connected to the power supply electrode and a second end of the power supply wiring line is connected to the second discharge element, wherein, in each of the groups, the power supply wiring line further includes a branch line that branches from a branch point which is provided on a path between the first end and the second end of the power supply wiring line, wherein, in each of the groups, one end of the branch line is connected to the first discharge element, and the power supply electrode and the first discharge element are connected to each other via the branch point and the branch line, wherein, in each of the groups, the branch point is closer to the second discharge element than to the first discharge element, and wherein the power supply wiring line and the branch line are arranged between two first supply ports which are adjacent to each other in the first direction.

15. A printhead comprising:

the discharge element substrate cited in claim 14;

an orifice configured to discharge a liquid under control of the discharge element substrate; and a liquid container configured to contain ink.

16. A printing apparatus comprising:

the printhead cited in claim 15; and a supply unit configured to supply a driving signal for causing the printhead to discharge a liquid.

17. The discharge element substrate according to claim 14, wherein the first discharge element is arranged between the power supply electrode and the second discharge element in the second direction.

18. The discharge element substrate according to claim 14, further comprising second supply ports arranged along in the first direction, wherein a column of the first supply ports and a column of the second supply ports are arranged in the second direction.

19. The discharge element substrate according to claim 14, wherein the first discharge element includes:

a first electrical contact connected to the first driving circuit; and a second electrical contact connected to the power supply electrode, wherein the first electrical contact and the second electrical contact are arranged along in the second direction.

20. The discharge element substrate according to claim 14, wherein the first discharge elements included in the groups are arranged along the first direction.

21. The substrate according to claim 14, wherein each of the first supply ports is arranged between the first discharge element and the second discharge element of corresponding one of the groups.

* * * * *